US011522313B2

(12) United States Patent
Tsai et al.

(10) Patent No.: US 11,522,313 B2
(45) Date of Patent: Dec. 6, 2022

(54) WATERPROOF CONNECTOR

(71) Applicant: PEGATRON CORPORATION, Taipei (TW)

(72) Inventors: Chien Yu Tsai, Taipei (TW); Shin Min Lee, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 17/477,242

(22) Filed: Sep. 16, 2021

(65) Prior Publication Data

US 2022/0216644 A1 Jul. 7, 2022

(30) Foreign Application Priority Data

Jan. 6, 2021 (TW) ..... 110200140

(51) Int. Cl.
*H01R 12/72* (2011.01)
*H01R 13/52* (2006.01)

(52) U.S. Cl.
CPC ..... *H01R 13/5213* (2013.01); *H01R 12/722* (2013.01)

(58) Field of Classification Search
CPC ..... H01R 13/5213; H01R 13/5202; H01R 12/722; H01R 12/716; H01R 12/724
See application file for complete search history.

(56) References Cited

U.S. PATENT DOCUMENTS 6,244,886 B1 * 6/2001 Strang ..... H01R 13/5202 439/271
10,797,429 B2 10/2020 Hsu et al.
2020/0348009 A1 * 11/2020 Ansems ..... F21V 15/01

FOREIGN PATENT DOCUMENTS

| | | |
|---|---|---|
| CN | 107681316 | 2/2018 |
| TW | 201633620 | 9/2016 |
| TW | 201803223 | 1/2018 |
| WO | 2019092749 | 5/2019 |
| WO | 2019244511 | 12/2019 |

OTHER PUBLICATIONS

"Search Report of Europe Counterpart Application", dated Apr. 4, 2022, p. 1-p. 9.

* cited by examiner

*Primary Examiner* — Tho D Ta
(74) *Attorney, Agent, or Firm* — J.C. Patents

(57) ABSTRACT

A waterproof connector disposed on a circuit board of an electronic device and inserted with a housing of the electronic device is provided. The waterproof connector includes a connector and a waterproof covering member. The connector is disposed on the circuit board, and the waterproof covering member covers the connector and a part of the circuit board. An outer surface of the waterproof covering member has multiple ribs, and the ribs contact the housing to provide waterproof protection for an inside of the electronic device.

6 Claims, 6 Drawing Sheets

WATERPROOF CONNECTOR

CROSS-REFERENCE TO RELATED APPLICATION

This application claims the priority benefit of Taiwan application serial no. 110200140, filed on Jan. 6, 2021. The entirety of the above-mentioned patent application is hereby incorporated by reference herein and made a part of this specification.

BACKGROUND

Technical Field

The disclosure relates to a connector, and more particularly, to a waterproof connector.

Description of Related Art

In order to expand the application of electronic devices and peripheral accessories, connectors are common application components in electronic devices.

In the conventional practice, a o-ring with soft material is sandwiched between the connector of the electronic device and the housing to provide waterproofing.

However, it is often the case that the o-ring interferes with the housing or other internal components during assembly, resulting in not being assembled in the expected position and causing water leakage.

SUMMARY

The disclosure provides a waterproof connector with a waterproof effect.

A waterproof connector of the disclosure is disposed on a circuit board of an electronic device, and is inserted with a housing of the electronic device. The waterproof connector includes a connector and a waterproof covering member. The connector is disposed on the circuit board, and the waterproof covering member covers the connector and a part of the circuit board. An outer surface of the waterproof covering member has multiple ribs, and the ribs contact the housing, so as to provide waterproof protection for an inside of the electronic device.

In an embodiment of the disclosure, the connector has an insertion interface, and the waterproof covering member covers the connector and exposes the insertion interface.

In an embodiment of the disclosure, a material of the waterproof covering member is rubber.

In an embodiment of the disclosure, an inner surface of the waterproof covering member contacting the circuit board has an adhesive overflow groove.

In an embodiment of the disclosure, the ribs are disposed on at least one of the outer surfaces of the waterproof covering member.

In an embodiment of the disclosure, the ribs are disposed on the outer surface of the waterproof covering member facing the housing, and abut against the housing.

In an embodiment of the disclosure, the ribs are disposed on the outer surface of the waterproof covering member facing a mechanical member of the electronic device, and abut against the mechanical member.

Based on the above, in the waterproof connector of the disclosure, the waterproof covering member covers the connector and a part of the circuit board at the same time, so as to provide the good waterproof effect for the inside of the electronic device. Therefore, such disposing method is also suitable for a connector that does not have waterproof specifications

DETAILED DESCRIPTION OF DISCLOSED EMBODIMENTS

Figure 1:
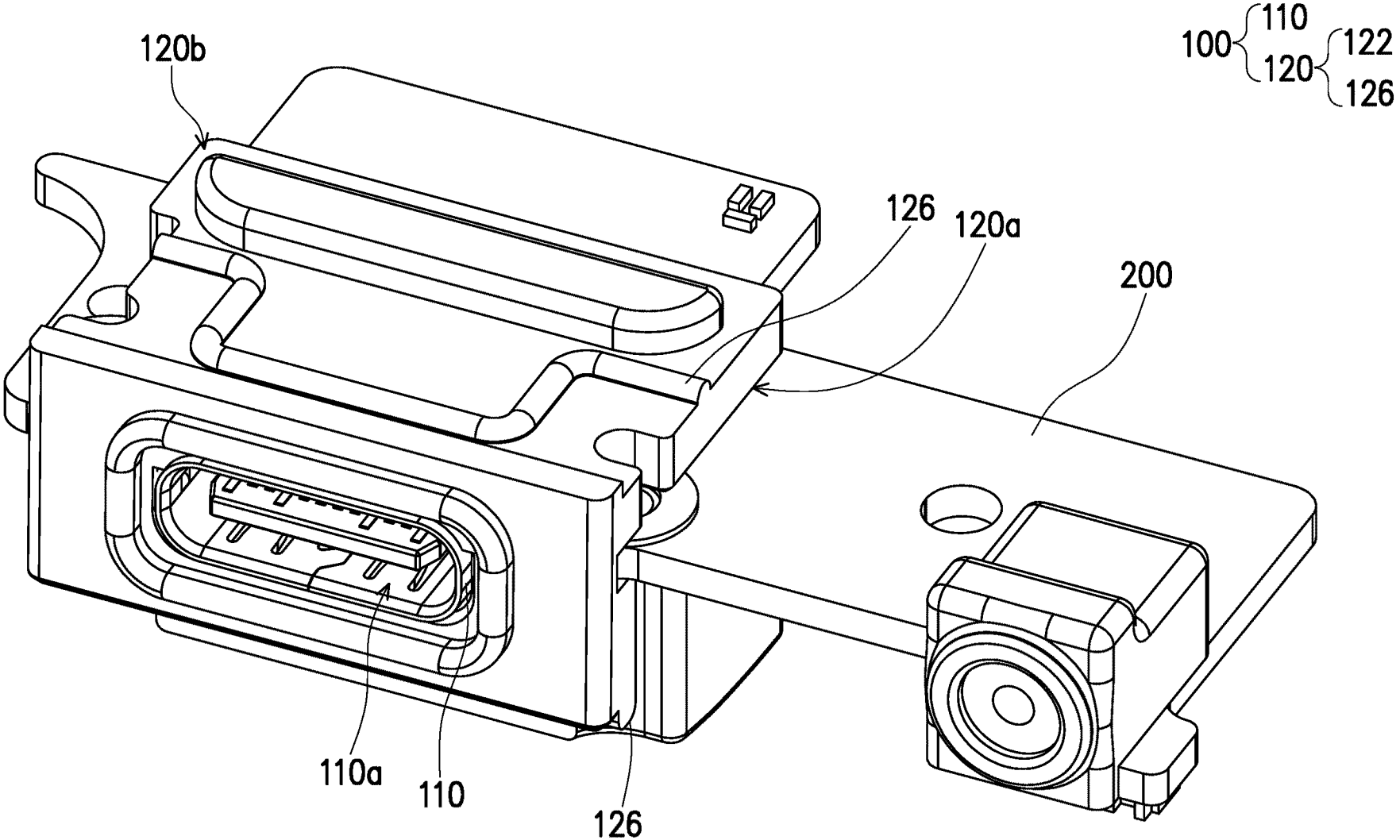
FIG. 1 is a schematic view of a waterproof connector according to the disclosure.
Figure 2:
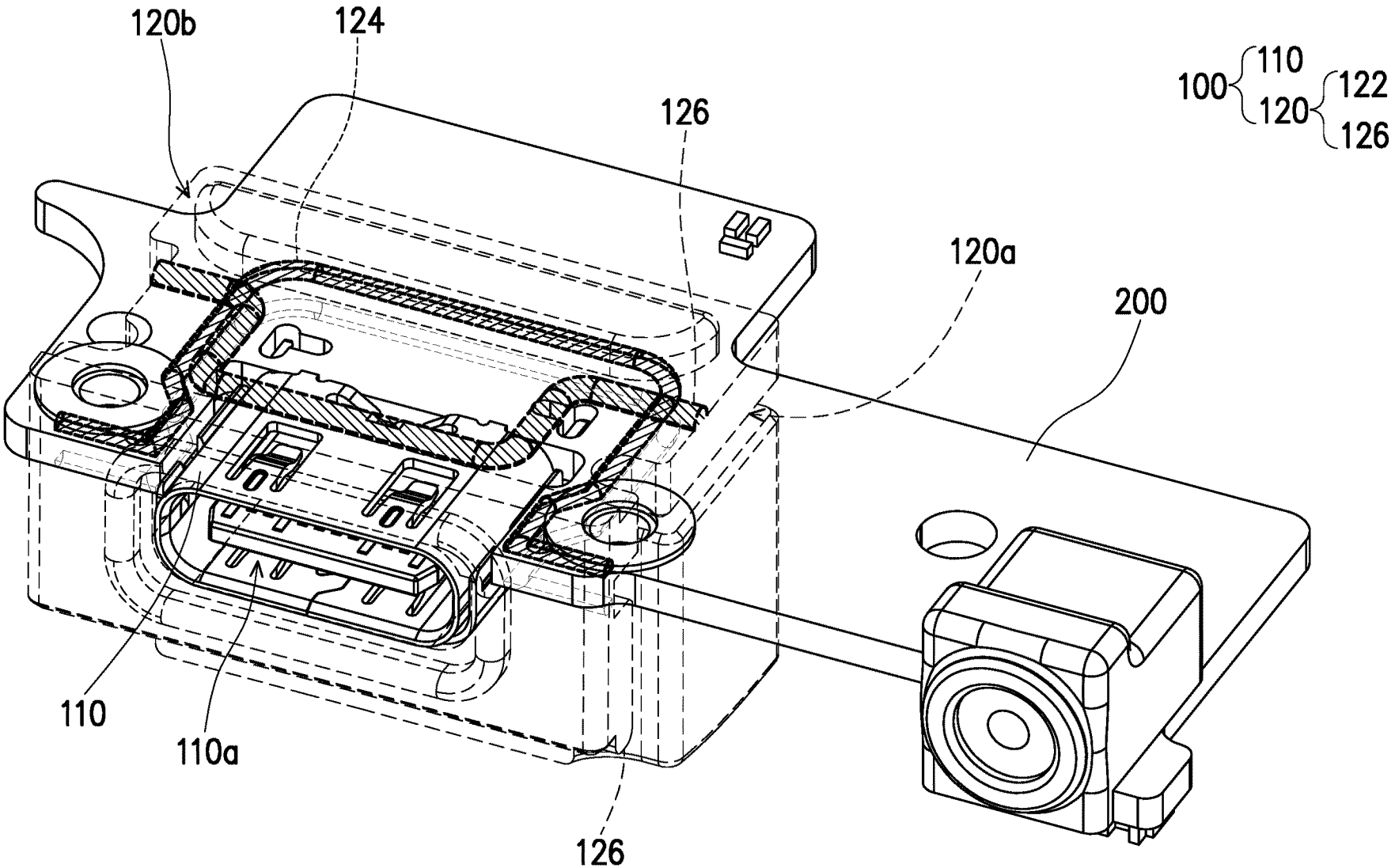
FIG. 2 is a schematic view of a waterproof covering member in FIG. 1 becoming transparent.
Figure 3:
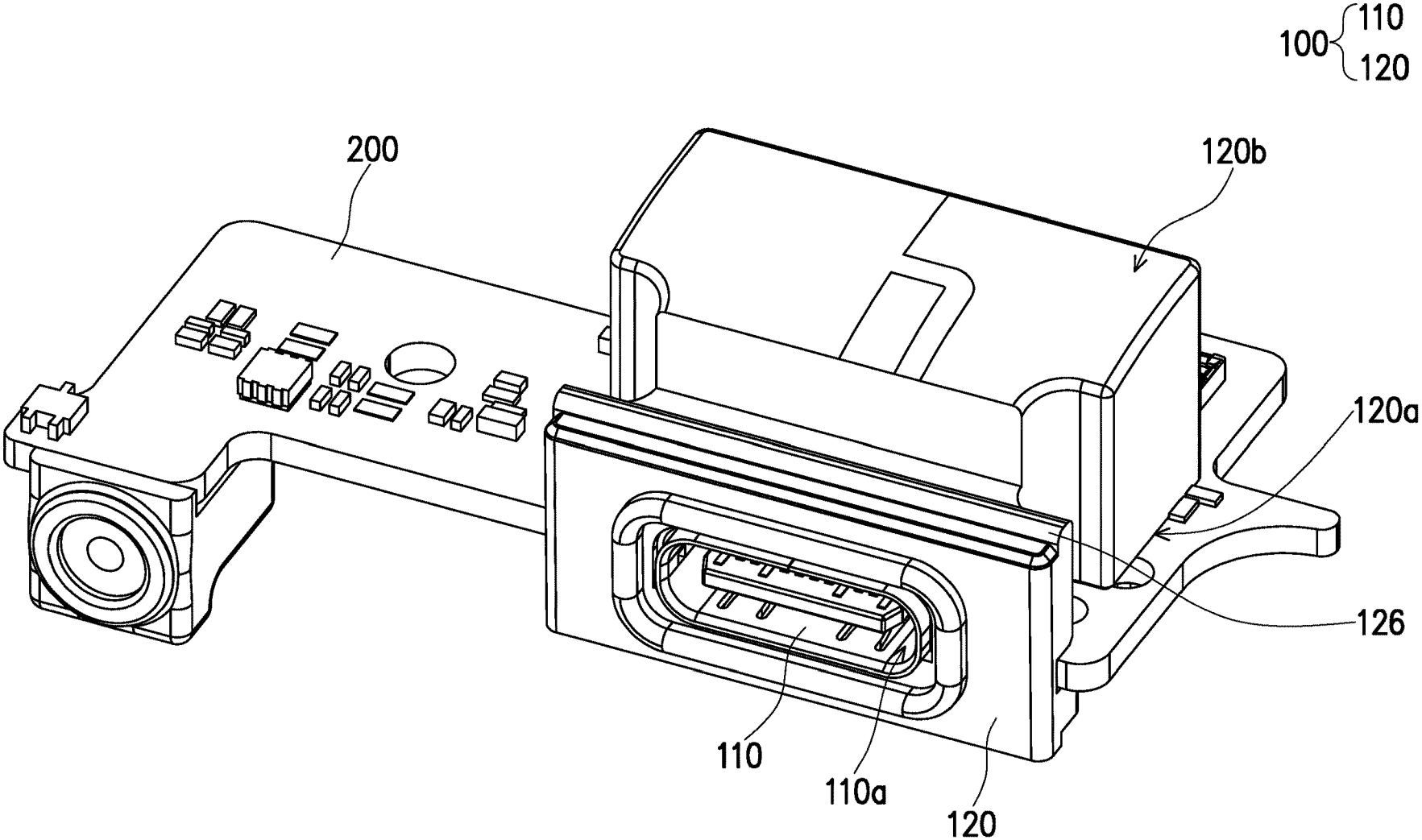
FIG. 3 is a schematic view of the waterproof connector of FIG. 1 from another perspective.
Figure 4:
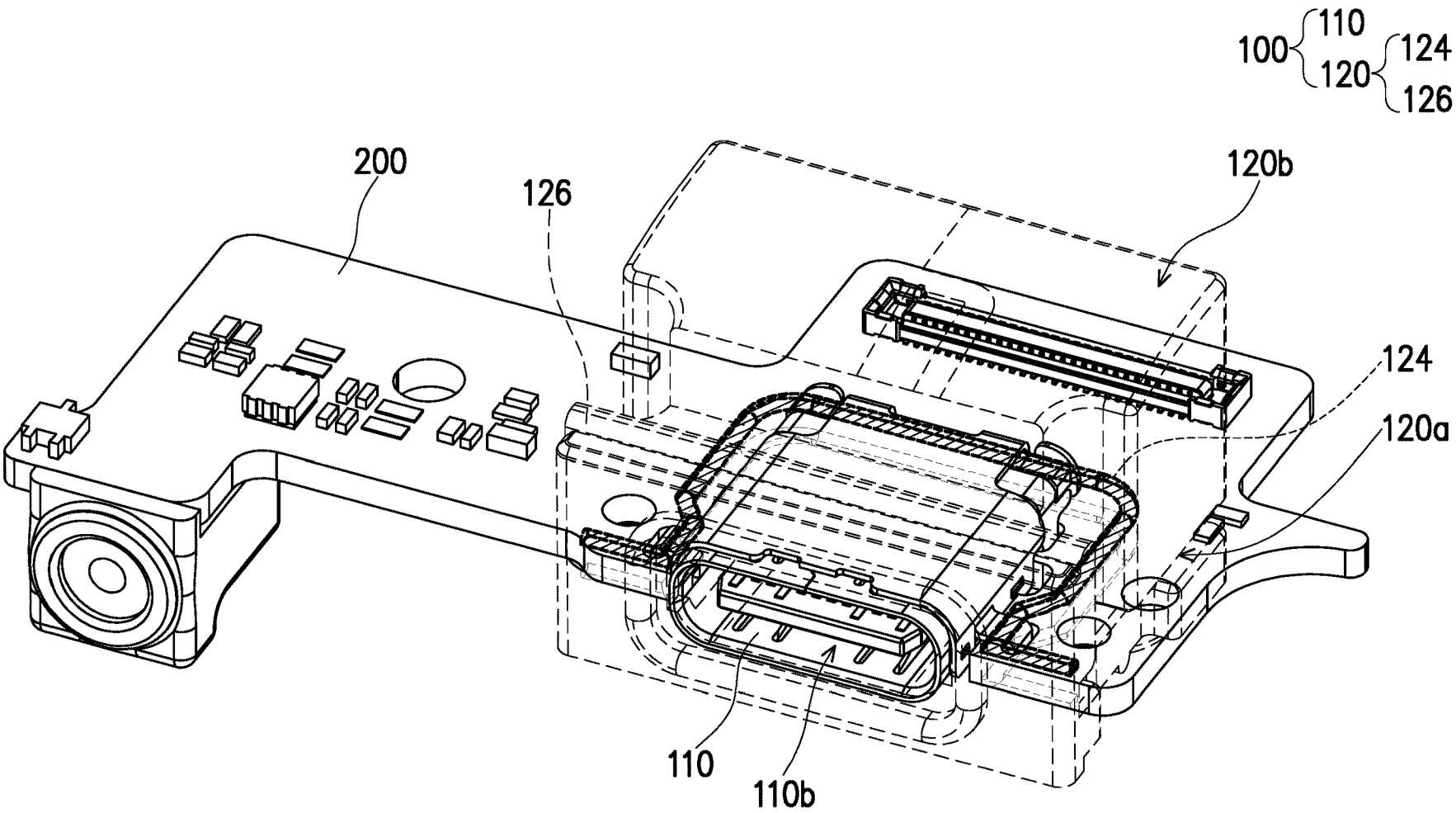
FIG. 4 is a schematic view of the waterproof covering member in FIG. 3 becoming transparent.

FIG. 1 is a schematic view of a waterproof connector according to the disclosure. FIG. 2 is a schematic view of a waterproof covering member in FIG. 1 becoming transparent. FIG. 3 is a schematic view of the waterproof connector of FIG. 1 from another perspective. FIG. 4 is a schematic view of the waterproof covering member in FIG. 3 becoming transparent. Referring to FIGS. 1 to 4 together, a waterproof connector 100 is disposed on a circuit board 200. The waterproof connector 100 includes a connector 110 and a waterproof covering member 120. The connector 110 is disposed on the circuit board 200 and electrically connected to the circuit board 200, and the waterproof covering member 120 covers the connector 110 and a part of the circuit board 200.

A material of the waterproof covering member 120 in this embodiment is rubber, but it is not limited thereto. Those skilled in the art may select other materials that may also achieve a waterproof effect according to requirements.

Figure 5:
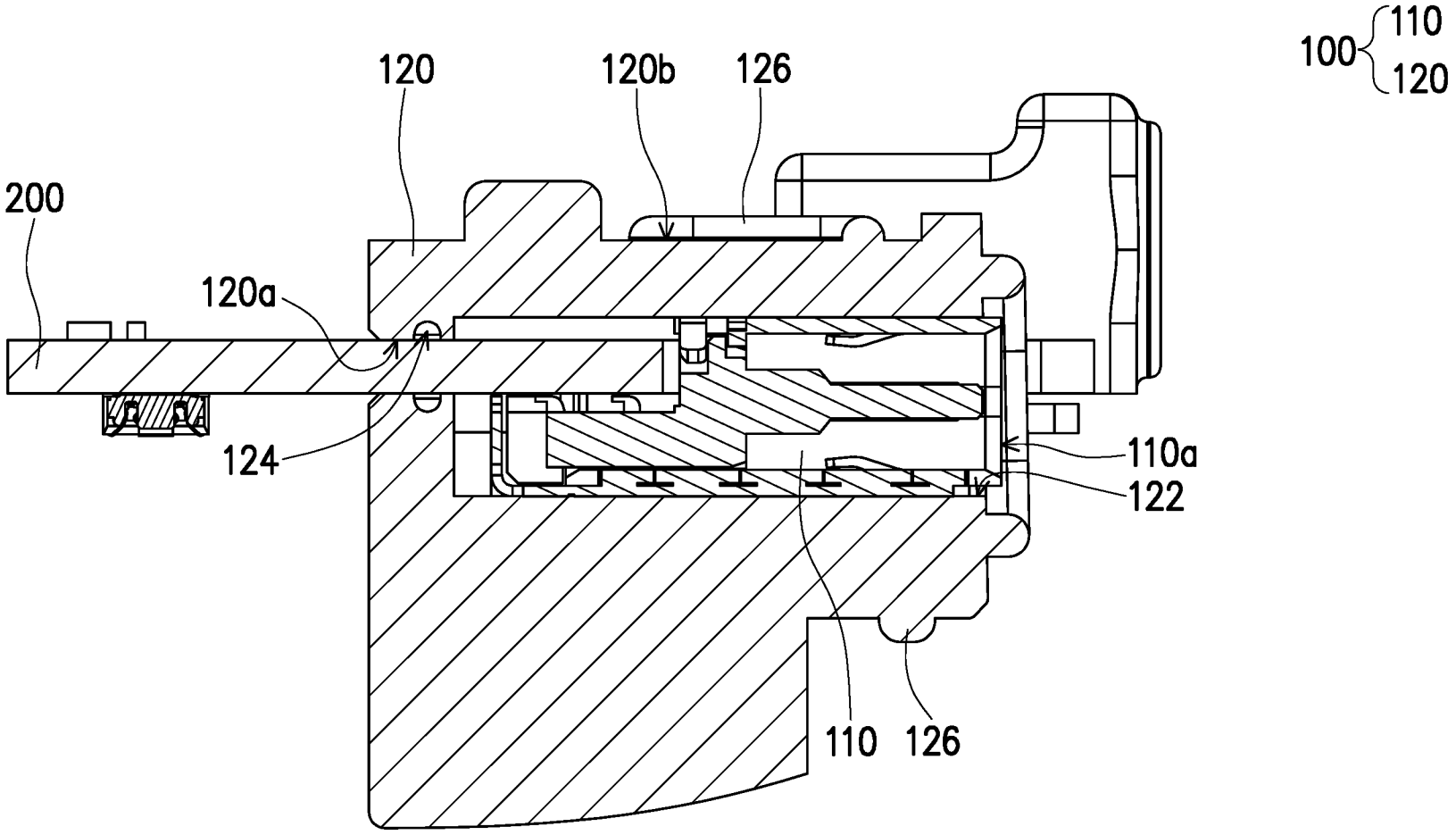
FIG. 5 is a cross-sectional view of FIG. 1.

FIG. 5 is a cross-sectional view of FIG. 1. Referring to FIGS. 2, 4, and 5 together, specifically, the connector 110 has an insertion interface 110*a*, and the waterproof covering member 120 covers an upper side, a lower side, a left side, a right side, and a rear side of the connector 110, and exposes the insertion interface 110*a*.

In addition, the waterproof covering member 120 may have an opening 122 with a shape of "U". The connector 110 is disposed in the opening 122 with the shape of "U", and then a part of the waterproof covering member 120 that exceeds the connector 110 is attached to the circuit board 200 by an adhesive. In order to prevent the adhesive from overflowing outside the waterproof covering member 120 and affecting other components on the circuit board 200, an inner surface 120*a* of the waterproof covering member 120 configured to contact the circuit board 200 has an adhesive overflow groove 124. Therefore, excess residual adhesive flows into the adhesive overflow groove 124 to be collected.

In light of the above, the waterproof covering member 120 covers the connector 110 and the part of the circuit board 200. That is, the circuit board 200 is provided with the connector 110 and a part around the connector 110. Therefore, a shape and size of the waterproof covering member 120 may be adjusted according to the requirements, so that the waterproof covering member 120 may further provide waterproof protection for a circuit near the connector 110 on the circuit board 200.

Figure 6:
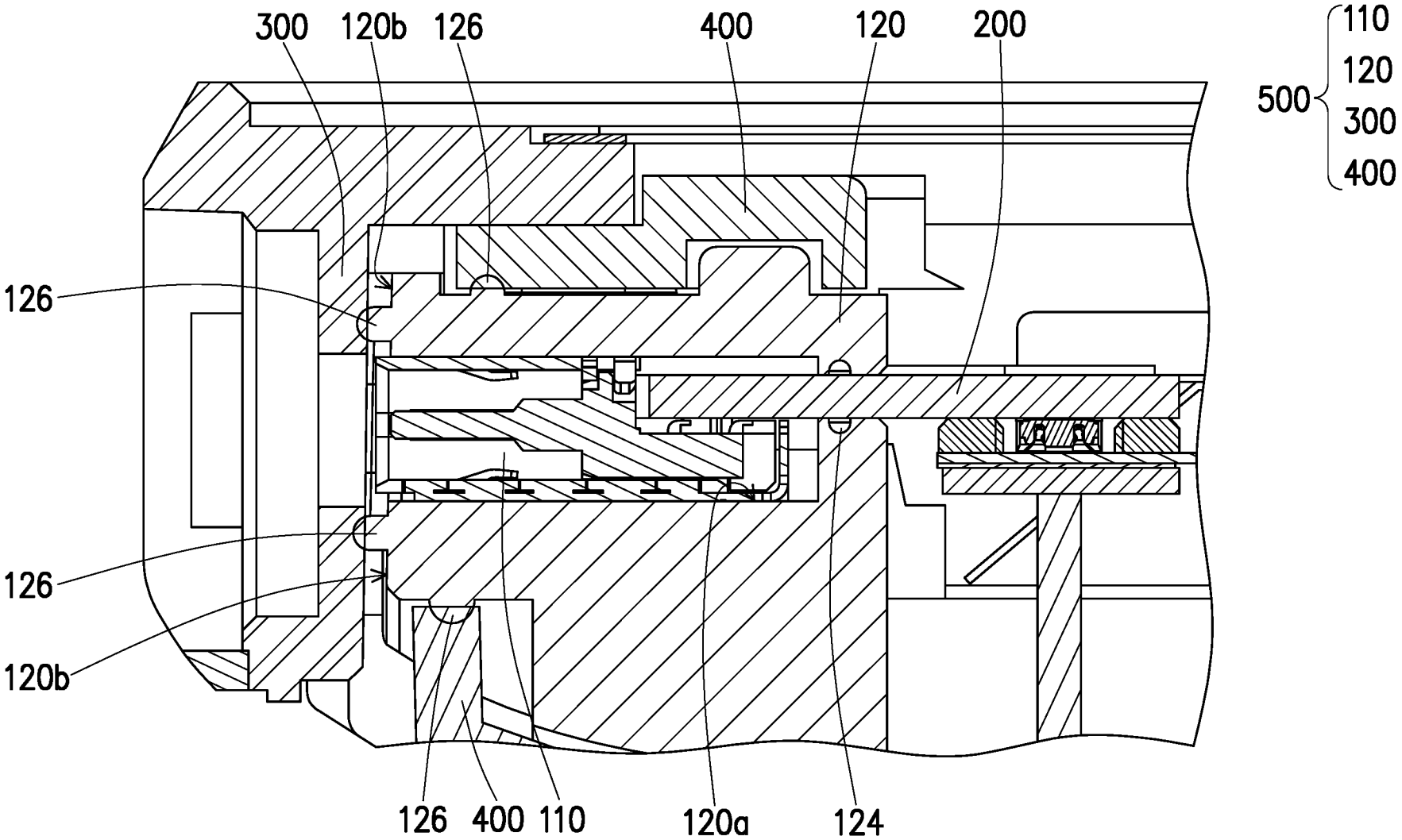
FIG. 6 is a partial cross-sectional view of an electronic device.

FIG. 6 is a partial cross-sectional view of an electronic device. Referring to FIGS. 1, 3, and 6 together, the circuit board 200 is disposed in an electronic device 500. The electronic device 500 may be a desktop computer host, a notebook computer host, a USB flash drive, or other suitable electronic devices. The electronic device 500 includes a housing 300, and the waterproof covering member 120 is inserted with the housing 300. In order to enhance the waterproof effect, an outer surface 120*b* of the waterproof covering member 120 configured to contact the housing 300 further has a rib 126, so as to further prevent water vapor from entering the housing 300. The rib 126 may be disposed on at least any one of the outer surfaces 120*b* of a top, bottom, left, right, front and rear of the waterproof covering member 120. The number of the ribs 126 disposed on each of the outer surfaces 120*b* is not limited, and the number of the ribs 126 may be adjusted according to the actual requirements. The rib 126 of the waterproof covering member 120 facing the housing abuts against the housing 300, and the rib 126 of the waterproof covering member 120 facing other mechanical members 400 disposed in the housing 300 abuts against the mechanical member 400. By the rib 126 abutting against the housing 300 and the mechanical member 400, the water vapor may be prevented from entering an inside of the electronic device 500, and the electronic device 500 has the good waterproof effect.

Based on the above, in the waterproof connector of the disclosure, the waterproof covering member covers the connector and the part of the circuit board at the same time, and abuts against the housing and the mechanical member disposed in the housing by the rib, so as to provide the good waterproof effect for both the connector and the circuit board. Therefore, such disposing method may be also suitable for a connector that does not originally have waterproof specifications.

In addition, the waterproof covering member not only covers an adjacent periphery where the circuit board is provided with the connector, but also extends a length of the waterproof covering member covering the circuit board according to the requirements, so as to expand a range of the waterproof cover member covering the circuit board, and further provide the waterproof protection for the circuit near the connector on the circuit board.

The description related to directional terms (such as upper, lower, front, rear, left, and right) are used to illustrate rather than limit the disclosure. It should be known for those having ordinary skills that when a reference point used as a description of the comparison is changed, the description of the direction is also different.

What is claimed is:

1. A waterproof connector disposed on a circuit board of an electronic device and inserted with a housing of the electronic device, wherein the waterproof connector comprising:

a connector disposed on the circuit board; and a waterproof covering member covering the connector and a part of the circuit board, wherein an outer surface of the waterproof covering member has a plurality of ribs, and the plurality of ribs contact the housing to provide waterproof protection for an inside of the electronic device;

wherein an inner surface of a part of the waterproof covering member that exceeds the connector is attached to the circuit board by an adhesive, and wherein the inner surface of the part of the waterproof covering member that exceeds the connector has an adhesive overflow groove.

2. The waterproof connector according to claim 1, wherein the connector has an insertion interface, and the waterproof covering member exposes the insertion interface.

3. The waterproof connector according to claim 1, wherein a material of the waterproof covering member is rubber.

4. The waterproof connector according to claim 1, wherein the plurality of ribs are disposed on at least one of the outer surfaces of the waterproof covering member.

5. The waterproof connector according to claim 4, wherein the plurality of ribs are disposed on the outer surface of the waterproof covering member facing the housing, and abut against the housing.

6. The waterproof connector according to claim 4, wherein the plurality of ribs are disposed on the outer surface of the waterproof covering member facing a mechanical member of the electronic device, and abut against the mechanical member.

* * * * *